US007749447B1

(12) United States Patent
Sauter, Jr.

(10) Patent No.: US 7,749,447 B1
(45) Date of Patent: Jul. 6, 2010

(54) N-CHANNEL, Y-ENERGY MODE, Z-COUPLED NESTED GAUSSIAN SURFACES FOR LIQUID(S) DISPENSING, LIQUID(S) TREATMENT, LIQUID(S) INTRODUCTION AND SOLID(S) PRODUCTION METHODS AND APPARATUS

(76) Inventor: Andrew Daniel Sauter, Jr., 217 Garfield Dr., Henderson, NV (US) 89074

( * ) Notice: Subject to any disclaimer, the term of this patent is extended or adjusted under 35 U.S.C. 154(b) by 1393 days.

(21) Appl. No.: 11/137,254

(22) Filed: May 25, 2005

(51) Int. Cl.
*B01L 3/02* (2006.01)

(52) U.S. Cl. ..... 422/100; 210/656; 250/288

(58) Field of Classification Search ..... 422/100; 210/656; 250/288
See application file for complete search history.

(56) References Cited

U.S. PATENT DOCUMENTS

| | | | | |
|---|---|---|---|---|
| 2,933,087 | A | 4/1960 | Hamilton | |
| 3,476,291 | A | 11/1969 | Glaser | |
| 5,275,016 | A * | 1/1994 | Chatterjee et al. | 62/381 |
| 5,916,524 | A | 6/1999 | Tisone | |
| 6,132,582 | A | 10/2000 | King | |
| 6,149,815 | A * | 11/2000 | Sauter | 210/635 |
| 6,245,227 | B1 * | 6/2001 | Moon et al. | 210/198.2 |
| 6,269,701 | B1 * | 8/2001 | Keech | 73/861.16 |
| 2002/0139751 | A1 * | 10/2002 | Zhang et al. | 210/656 |
| 2002/0190203 | A1 * | 12/2002 | Valaskovic et al. | 250/288 |

OTHER PUBLICATIONS

Sauter, Jr. et al., ""Electric" Zip Tips™, Preliminary Results", Apr. 1, 2002, Journal of the Association for Laboratory Automation, vol. 7 Issue 2, pp. 52-55.*
See Proceedings For Labautomation 2005 Poster Session of Sauter et al.
See Gather 2001 American Laboratory Sauter et al.

* cited by examiner

*Primary Examiner*—Jill Warden
*Assistant Examiner*—Jonathan M Hurst

(57) ABSTRACT

Femtoliter to milliliter volumes of one or a plurality of different liquids are accurately transported, dispensed and/or treated where the fluids are energized electrokinetically or in a hybrid mode where auxiliary energy sources including but not limited to pneumatic, piezoelectric; peristaltic; ultrasonic; thermal; gravitational, acoustic are employed concurrently or sequentially to transport liquids for various purposes from diverse devices. Liquids in nested Gaussian surfaces or common liquid handling devices (e.g., syringes) can be energized by electric induction or conduction of lumen or targets or both and are optionally concurrently or sequentially combined with non electrical energy to effect highly accurate volumetric and spatial liquid transport with active or passive flight direction yielding non touch or touch liquid sample placement, parallel dispensing, with or without filtration, SPE, LC, or other treatment technologies for scientific instrument introduction (e.g., MALDI/ESI), drug delivery, diagnostics, manufacturing of products, product tagging, sample preparation or related applications.

15 Claims, 20 Drawing Sheets

Line Voltage
HV PS
Switch Selector
1/R
TARGET
TARGET 48
48
48
48
48
48
24
24
24
38
38
38
39
39
39
55
55
55

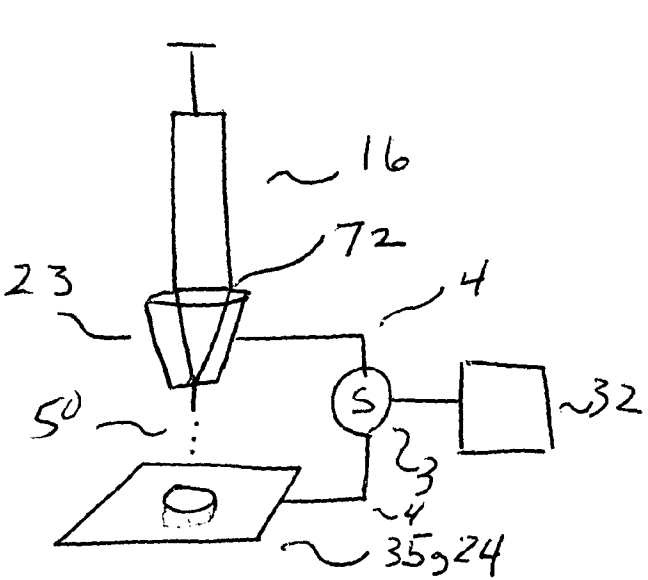
18b
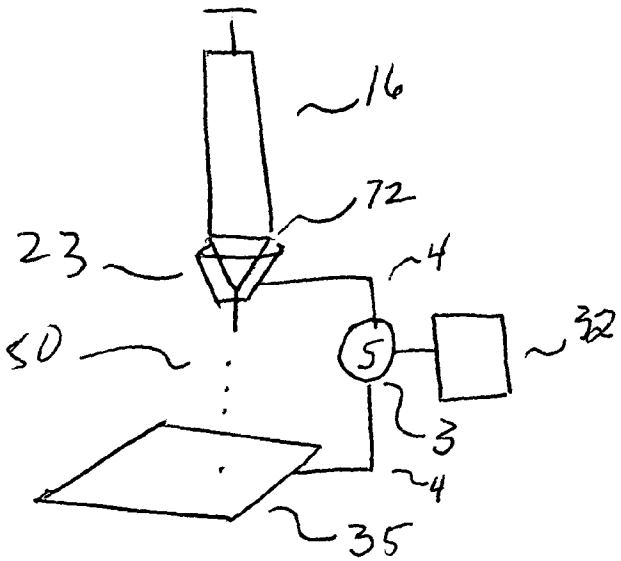
18a
Figure 18

N-CHANNEL, Y-ENERGY MODE, Z-COUPLED NESTED GAUSSIAN SURFACES FOR LIQUID(S) DISPENSING, LIQUID(S) TREATMENT, LIQUID(S) INTRODUCTION AND SOLID(S) PRODUCTION METHODS AND APPARATUS

BACKGROUND

Accurate and precise liquid movement or transport of dispensing across the macro, micro and nano worlds to a destination is of interest in countless areas including: drug and liquid product manufacturing; proteomics; genomics; bio and other agent detection; forensics; home and other health care; environmental and other areas and manufacturing of all types. The ability to accurately and precisely transport liquids can be employed to manufacture drugs or prescriptions; prepare samples for chemical analysis or for medical diagnostics, bioagent detection or handling or for forensics testing; to place chemicals, drugs or samples onto food, plants, animals humans or other objects or into scientific or other instruments or to perform isolation and purification functions; such as, filtration; solid phase extraction and liquid chromatography. The ability to manipulate small and large quantities of liquids using electric fields has other lesser known potential including: manufacturing new entities such as electronic components; frozen charged functionalized chemical entities that we have called nanoliter-sicles, repairing crystalline optics for large lasers and increasing the dynamic range of solution transport to existing pumping systems of diverse types. Devices that transport low quantities of liquids for such purposes have historically been largely mechanical in nature and they include: microliter syringes of all types; capillaries with attached bulbs; multi-channel pipettes and many different types of common pumps. More recently other devices have been applied to transport small quantities of liquids for various purposes including: piezoelectric devices; ink jets and other electromechnical devices. Such devices are not capable of dispensing liquids and performing useful functions across the macro, micro and the nano regimes (i.e., from mLs, to uLs to nLs to pLs to fLs) singly or in parallel with one source of energy. Either they cannot accurately transport the liquids across such a dynamic range or they have adverse properties including: inability to overcome adhesion and/or cohesion of small volume of liquids or liquid drops adhering to surfaces and as such they must touch off the liquid possibly contaminating the liquid or target, the device or both. Alternatively, even when for example low volumes of liquids are produced (but not higher volumes) they are not directed by the drop producing process and they can take trajectories that are not directed to locales causing errant location dispensing. Also, all low volume dispensing systems have large dead volumes, are complicated, and expensive in design and requiring at least one energy source per channel. Also they can exhibit have adverse electrochemistry; produce joule heating; or combinations thereof; that impact reliability and cost. Also, such devices again, cannot create and energize liquids, creating either drops or sprays, launch (i.e., push or pull) such drops or sprays to targets through the air as it actively directs the liquids trajectories to locales or targets that can be non-conducting or conducting without touching the target as it provides the energy to overcome the adhesion and cohesion of a liquid or liquids in drop, spray or hybrid form on the nested gaussian surface, N channels at a time with a minimum of one source of energy.

Technology that we have called induction based fluidics can make a simple capillaries of channels dispense liquids over more than nine order of magnitude and it has massive application space in matrix assisted laser desorption ionization mass spectroscopy in cancer diagnostics, polymer characterizations, and many other areas of health care and basic research and in manufacturing of drugs and special entities and elsewhere.

We have patented (U.S. Pat. No. 6,149,815) technology that can dispense liquids as it also performs functions across a massive dynamic range of literally in certain configurations and energy from mLs to fLs that has no moving parts, no or little joule heating, no adverse electrochemistry (i.e., faradaic processes) and that can perform parallel dispensing, parallel solid phase extraction, parallel filtration, parallel LC and parallel instrument introduction and more using as few as one source of energy where for N channels where N can literally be a very large number, as it directs the liquid to targets. In more recent work, we have taken this patented tool set that we call induction based fluidics and we have expanded the capabilities to small, less complicated even handheld devices that can dispense, literally fly liquids, as it directs liquids in the uL, nL and pL volume range using off-the-shelf devices like microliter syringes, or modified pipette tips to developing totally new technology that can place nanoliters onto humans or make MALDI spot plates in parallel or manufacture charged frozen nanoliter spheres that we have called nanoliter-sicles that can be aspirated by charged on non-charged rods, and as we have merged this IBF technology into more traditional older pumps; so that, IBF can be applied in tandem to other pump technology gaining the benefit or IBF including a wide dynamic range, highly parallel dispensing and other sample treatment options, excellent volumetric and spatial accuracy and precision plus unique capabilities and significant advances to larger fields of application.

In summary, this application extends IBF where this liquid transport technology that can employ as little as one source of electrical energy alone or use multiple sources of energy in tandem to transport, launch or fly, move or dispense one or more liquids as a flow, drop or spray to non-conducting or conducting targets one at a time or in a highly parallel manner across the mL, uL, nL, p L and fL dynamic volume range as it directs or attracts the liquid actively or passively to precise locations on inanimate or animate targets whether they are conductors or nonconductors. When the nested, gaussian surfaces contain filters or frits, SPE media, chromatographic phases, or other functionalized media the device can perform functions on the liquids; such as, filter, extract, chromatograph, purify and place or otherwise transform the liquid or its contents as they serially perform the transport function in a parallel mode optionally placing the liquid onto a target or targets be they surfaces, containers, scientific instruments, chemicals, drugs, food products, plant, animal or human subjects or other targets as it provides one or more ways to quantify the volume, and locations of the liquid/s providing other ways to facilitate operation.

Because the physical movement of fluids is so elementary to so many processes in biotechnology, health care, manufacturing, daily life and other areas it is impossible to adequately address all applications of this matter transport technology.

SUMMARY OF THE INVENTION

Apparatus electrokinetically energizes and transports liquids to locales or targets through nested gaussian surfaces independently or optionally in a hybrid mode using electrokinetic and other energy sources; such as, plungers; siphons; pneumatic pumps, piezoelectric pumps, peristaltic pumps, ultrasonic pumps, thermal energy, gravitational energy, manual energy or other energy sources combinations transports or dispenses milliliter, microliter, nanoliter and picoliter quantities of liquids with an accuracy and the precision of a few percent without or with touching the target or targets using one nested gaussian surfaces or a series of coupled or joined nested gaussian surfaces which can have the same or different cross sections and which can exist in a singular or plurality of many similar or different coupled nested gaussian surfaces. Such surfaces can be handheld, mounted to holders in parallel or joined into a plurality of a series of such surfaces mounted and or otherwise attached to a robotic platform of x,z of other geometry such that electric energy can be applied to the surfaces individually or collectively via electric induction or via a direct wired connection to any nested surface or series of nested gaussian surfaces or to liquid contents thereof or optionally to any physically disconnected or physically connected target or targets where the gaussian surfaces or the targets can be Made of nonconductors or conductors or any combinations thereof, as it uses passive or active surfaces to direct the liquid or its parts to targets be they vessels, surfaces, instruments, food, plant, animal or human subjects.

The apparatus consists of a unipolar or bipolar DC power supply which may be arc protected, current limited and optionally programmable coupled optionally to a RF power supply whose individual energy can be combined with the DC energy in any mixture and applied to the any gaussian surfaces or its electrically disconnected targets via induction or by direct electrical connection to any or all of such surfaces where the potential can be turned on or off using a switch in a ballistic manual mode or alternatively using a selector switch and a potentiometer or alternatively an auto transformer that can be employed to apply a constant potential or that can be manually changed in a positive or negative fashion to effect a dynamic change of potential or in a programmed by mode that uses a computer or microprocessor driven circuit to drive the programmable power supply or supplies that can take the applied potential from any value V1 to any value V2 using any C++ function or series of C++ functions applied to any gaussian surface individually or collectively or to any physically connected or disconnected target or targets. The apparatus further consists of surfaces made of conducting or non-conducting materials that can actively or passively form and direct the liquid as it emanates from the last gaussian surface prior to launching to the target or targets that may be charged or non-charged.

The device can optionally consist of various options to facilitate operation and to verify the operation of this technology including: a source of light to aid in visualizing targets such as lenses and LED which may optionally be fed from a fiber optic cable; a source of laser or other light to make spots of exact, known dimensions near adjacent to targets to aid calibration via machine visions techniques such as pixel counting; a foot pedal that can be employed to control the energy application to the devices or targets; a motorized plunger that can fit into the gaussian surface or surfaces to push the liquid to grow drops or otherwise transport or produce drops of flow for transport through media for subsequent transport to targets; coils or other current measuring devices to measure the charged liquid transport through a space from a gaussian surface verifying a dispense or optionally use machine visions techniques; such as, pixel counting of liquid blots on surfaces or video recording to further or independently verify the accuracy and the precision of liquid transport to a receiver or a surface; employ one disposable gaussian surface or more than one as the body of the device, as a tip or as the entire liquid holder; a series of selector buttons on the device or on the power unit an IR remote to control and to select the energy level and energy path of an experiment; mounted or detachable volumetric scales with lenses to visualize and measure the liquids; a charge station or stations where the one or more joined, nested gaussian surfaces can be electrically charged by direct connection to or by induction from a voltage source; assorted electrical attachments provide energy to any gaussian surface or its contents; compression and other fittings to join gaussian surfaces and disposable tips made of fused silica, polypropylene, quartz, PFTE, optionally equipped with flits, chromatograph or other media, and themselves potentially coated with PFTE, metals, polymers, or other inert or conductive material/s with or without electrical leads, a cradle that can hold the joined, nested gaussian surfaces, batteries, charging circuitry and circuitry to sense the liquid level or plunger position with alpha numeric LED and other displays, a holder or set of holders that can isolate the joined, nested gaussian surfaces from or optionally connect them to ground; compression, screw based or quick connect or zero dead volume unions to join or couple gaussian surfaces made of quartz, fused silica, polypropylene, PFTE and or coated there to with inert, metallic or non-conducting materials,

BRIEF DESCRIPTION OF THE DRAWINGS

FIG. 5 is a similar version of the preceding examples, where both an electrokinetic and a normal pump (e.g., peristaltic) are used to move the liquid, create drops on the tip and to drop them onto dry ice or other cold surface or liquid; such that, by so doing in an electrical field the drop remains electrically charged and can be aspirated by charged rod and the like.

FIG. 12 shows a complete evolved nanoliter, microliter syringe that can accurately move its plunger using a gear/wheel train as it supplies energy to either the liquid, the glass capillary or to targets either remotely or locally via both a selection switch than can be disconnected. the device has various accoutrements to visualize the liquid and read the scale and to selected paths or modes via an IR remote. Note the device or the target or targets can be charged to either push or pull, i.e. literally fly, the charged liquid drops grown on the disposable tip with the plunger, to the target or targets.

FIG. 18 shows two examples of a syringe and or a pump dispensing onto a surface and into a device using switchable energy application.

DETAILS

Figure 1:
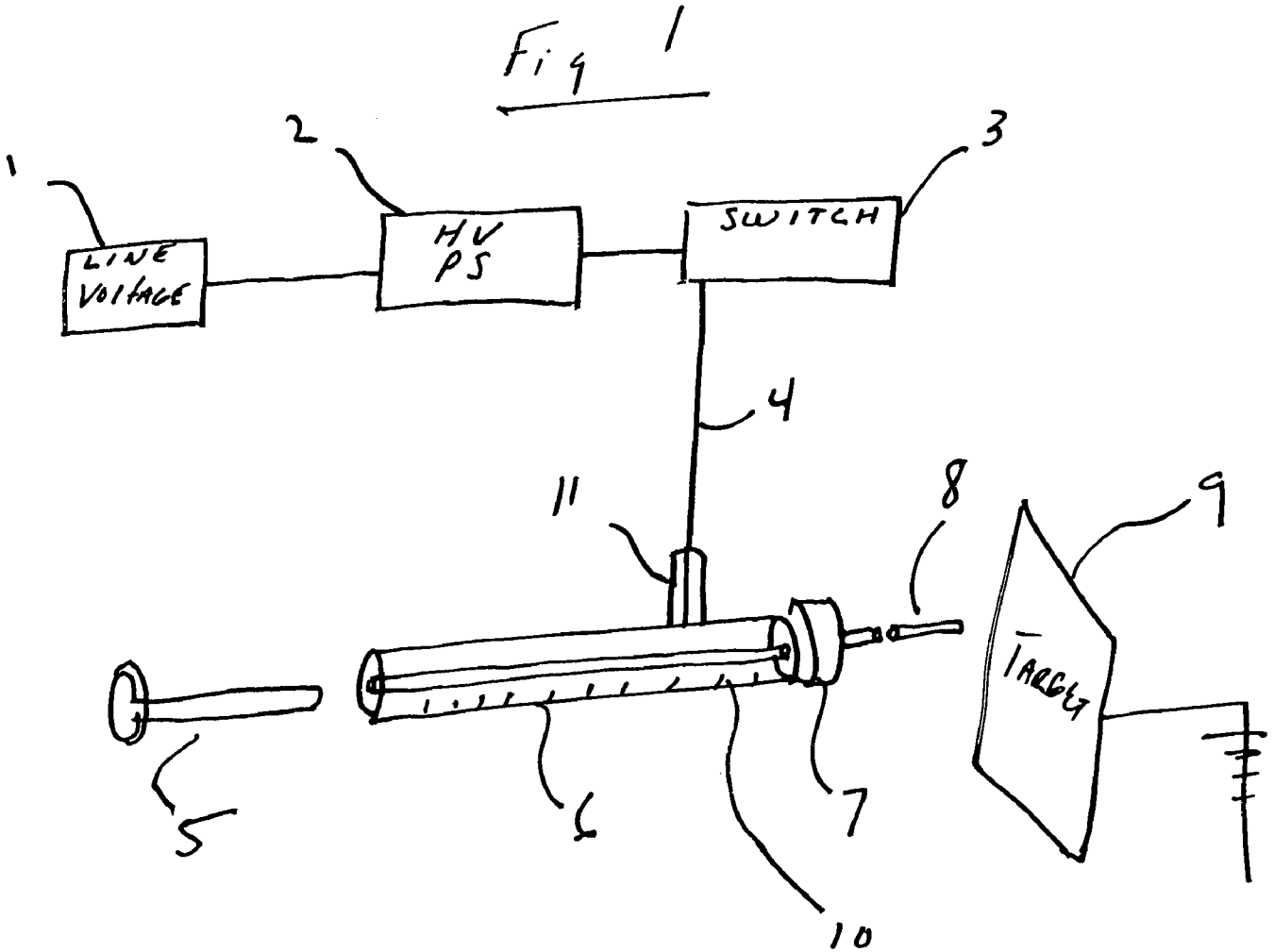
FIG. 1 is presents a circuit, modified syringe and a target that can produce drops or sprays on or at the tip and fly them to the target which is shown her as plate, but could also be a plant, animal or human subject.
Figure 2:
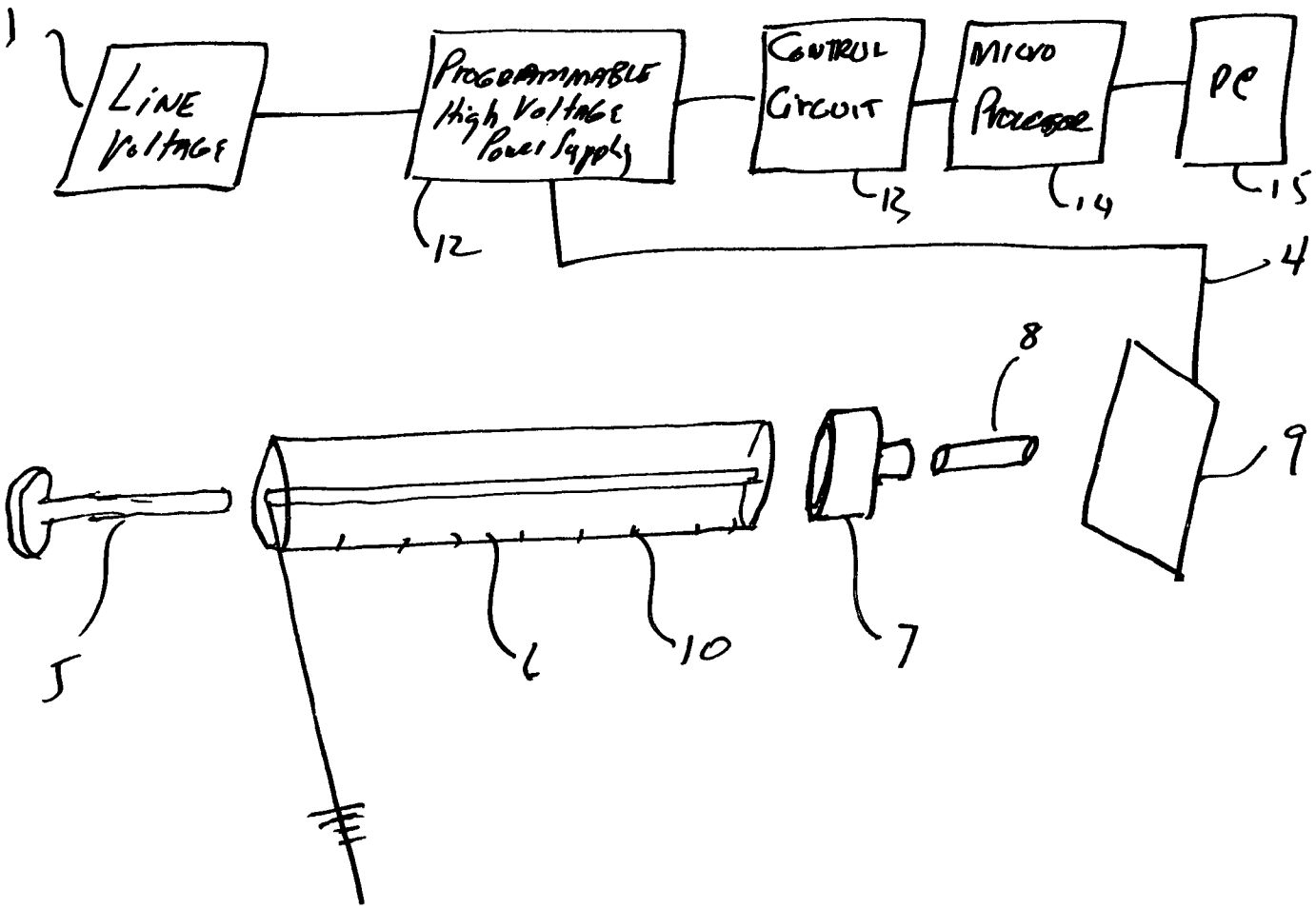
FIG. 2 is an overall alternate set up for the operative portion of the apparatus where the energy is placed on the target and it is done so from a programmable, bipolar (optional) current limited, arc protected power supply.
Figure 3:
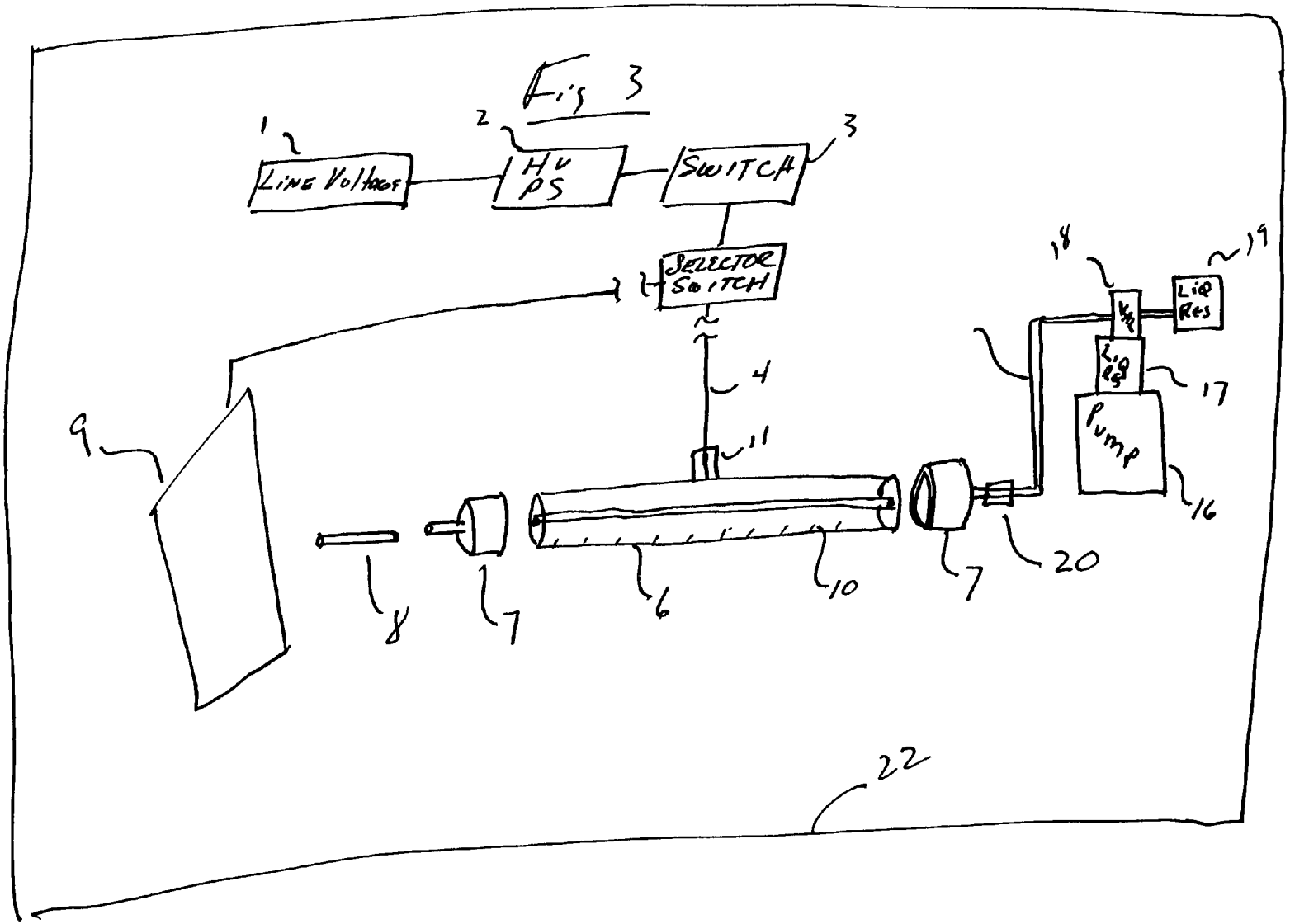
FIG. 3 presents a syringe like device that has both an electrokinetic source of energy to charge the ether the drops or a plate and an alternate source of energy such as a syringe pump all of which is located in a hood and faraday cage.
Figure 4:
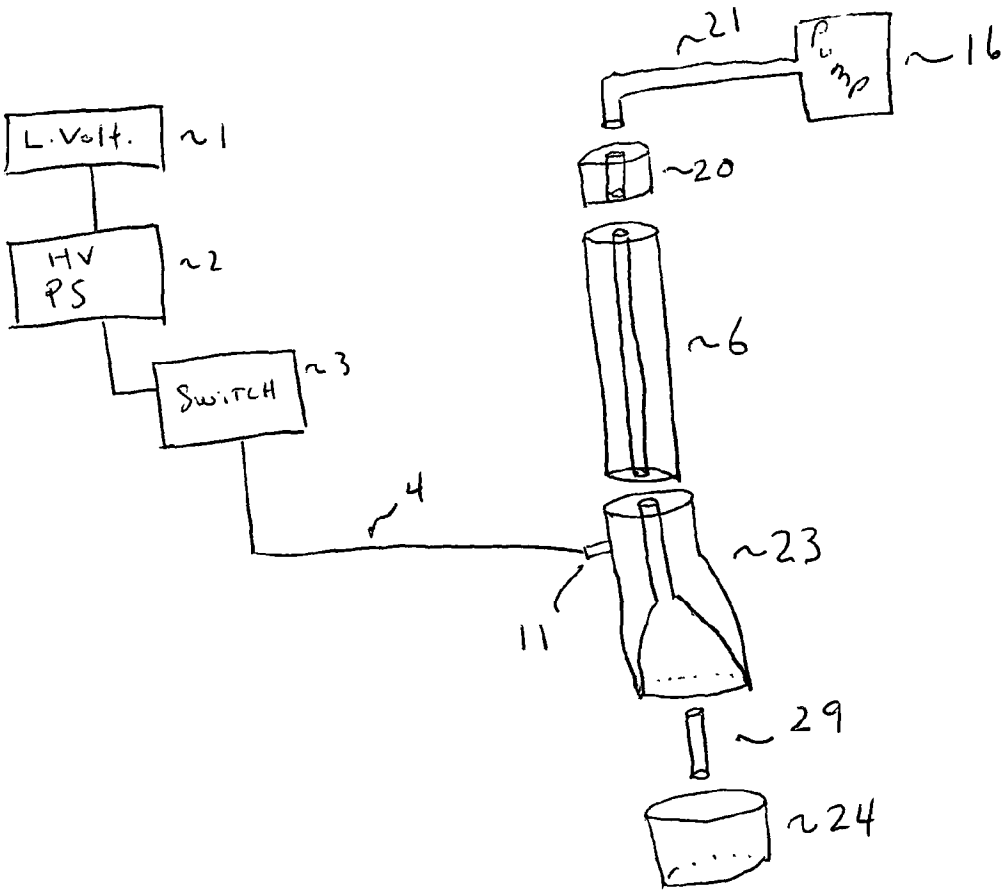
FIG. 4 shows a circuit to a capillary which is also fed by a pump. In this mode the tip cover serves to actually charge, form and direct the liquid to the container below.
Figure 5:
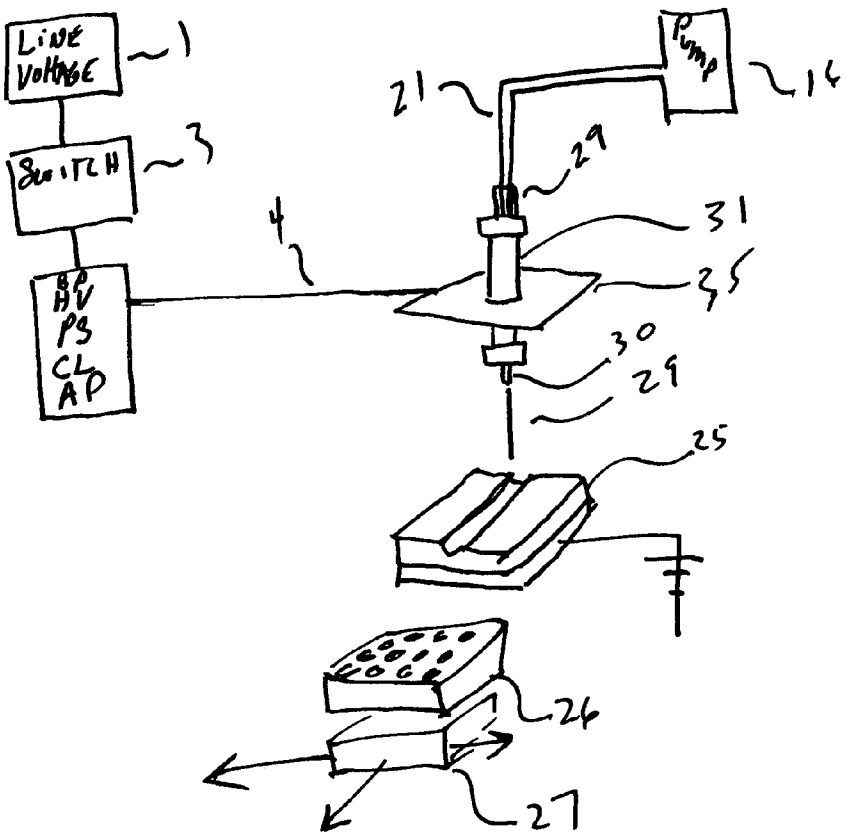
Figure 6:
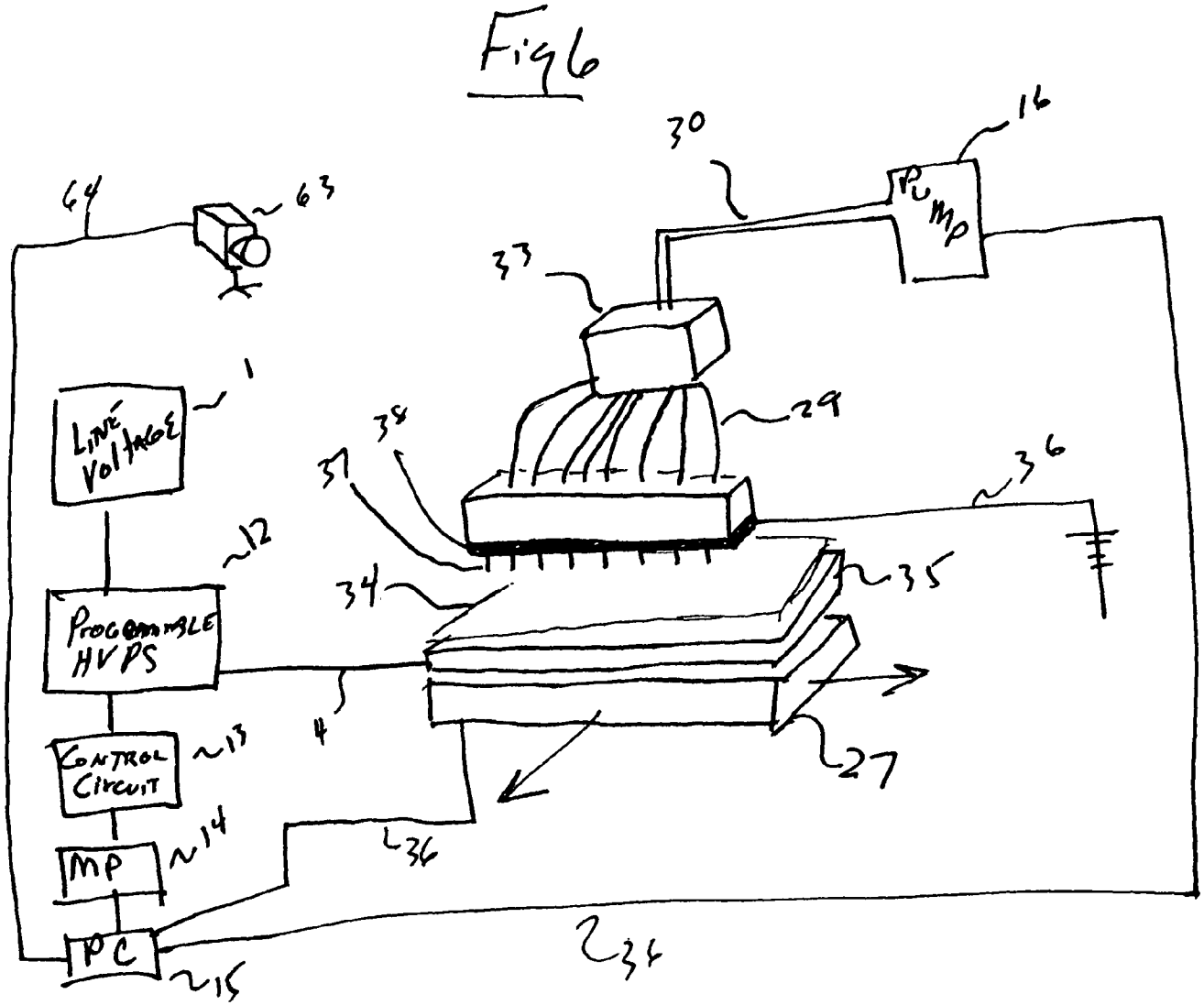
FIG. 6 is comprised of a pump, an programmable energy circuit that energizes the liquid coming from eight liquid chromatography columns ultimately onto a surface which can be moved by a robotic platform and from which video can be taken for post acquisition or near real time analysis.
Figure 7:
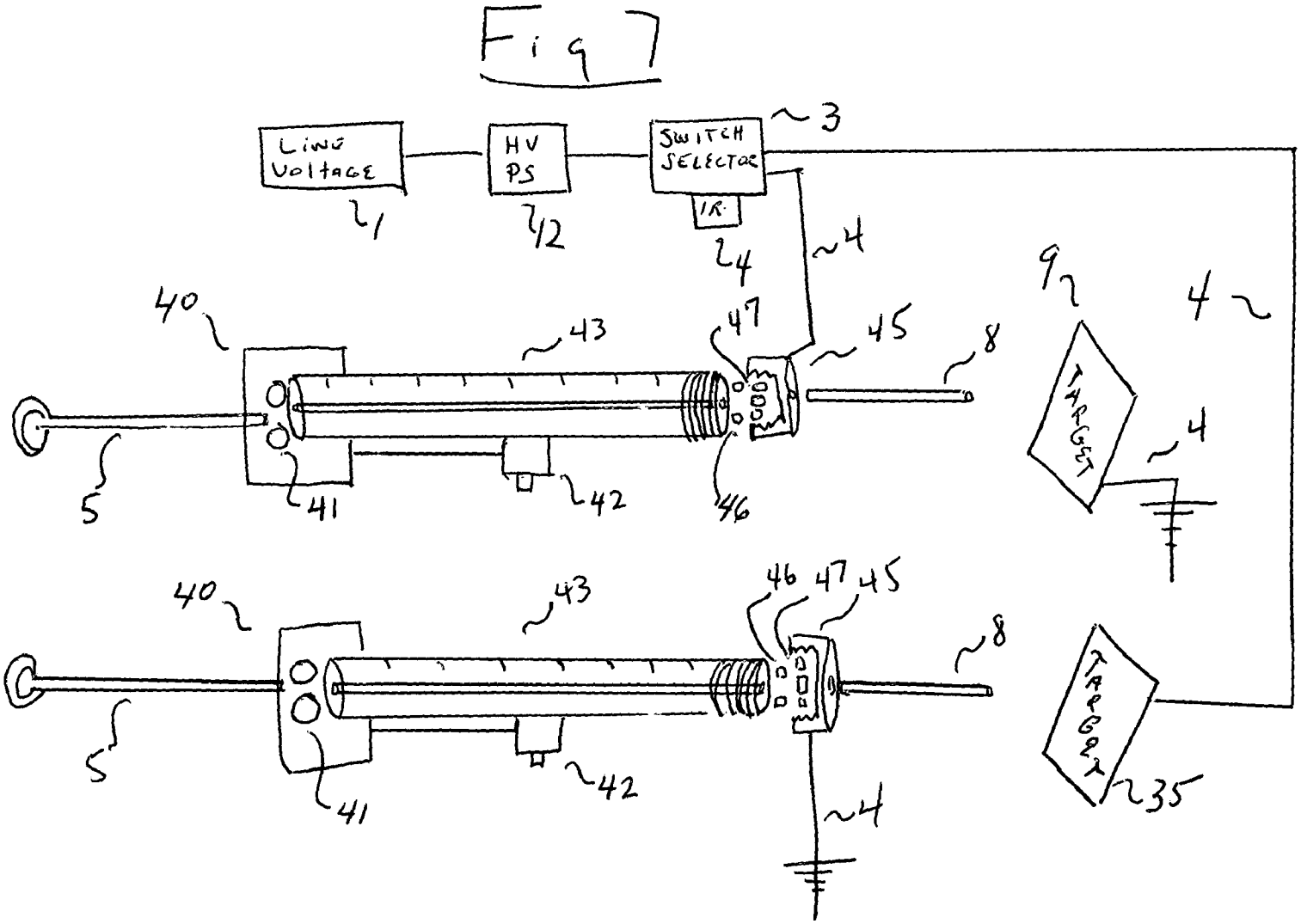
FIG. 7 is comprised of a circuit and a selector switch to energize either a target or a syringe which has battery operated motor and transmission wheels to move the plunger of wither device via a switch that employs an IR remote circuit.
Figure 8:
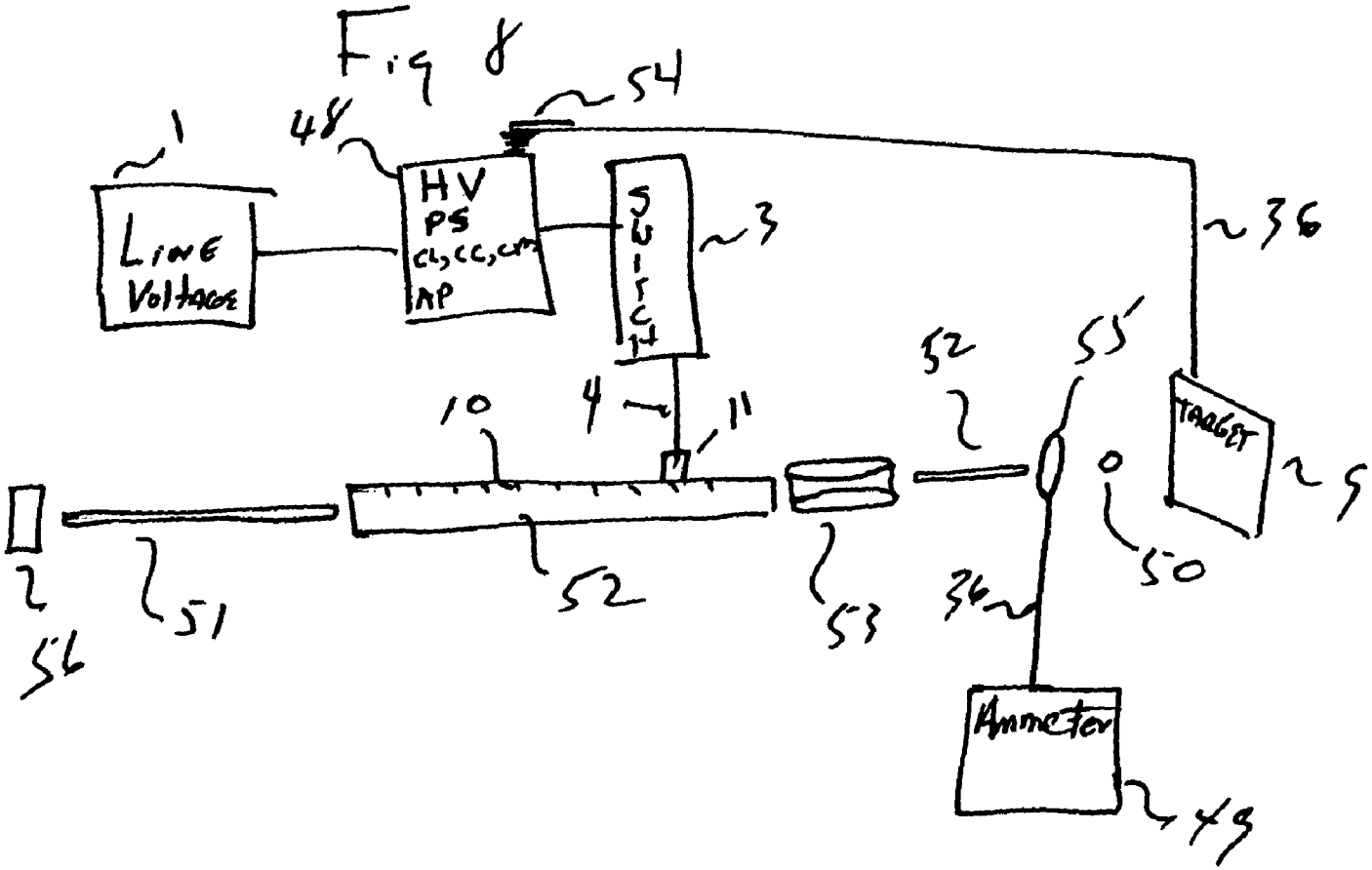
FIG. 8 shows a capillary with a fiber optic plunger that employs a compression union to attach a tip and which has a ammeter to measure the current induced by the charged drop as it goes through the loop to the grounded target.
Figure 9C:
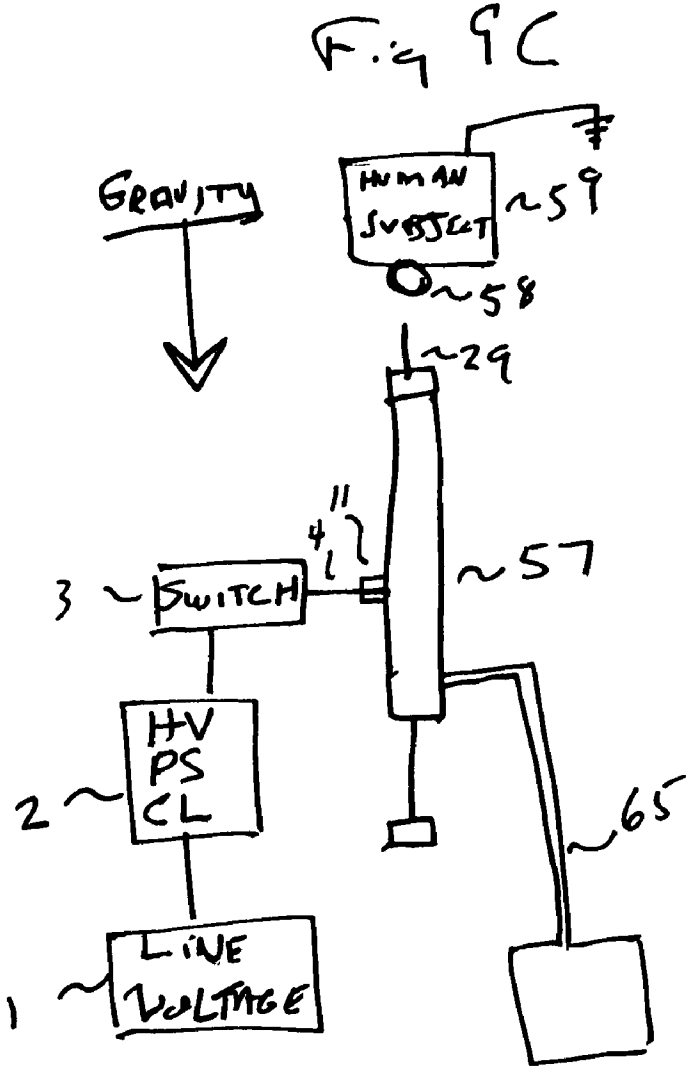
FIGS. 9A, 9B and 9C show a Hamilton 10 uL microliter syringe initially, then B shows a drop on the tip of a piece of PTFE coated fused silica with 9C showing that the drop flys up to a human subject when the syringe is charged by connection of the syringe (in this case to the non-conducting barrel) to an appropriately high negative or positive potential that is current limited, and hence safe and that can be hand-held or held by holder as in this case.
Figure 9B:
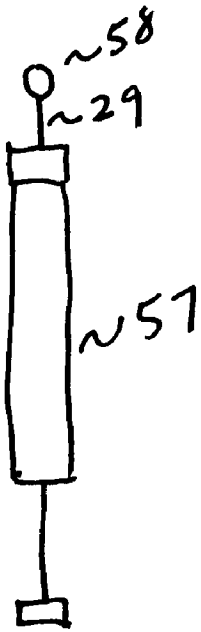
Figure 9A:
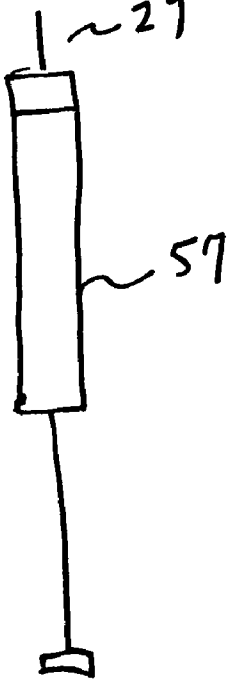
Figure 10:
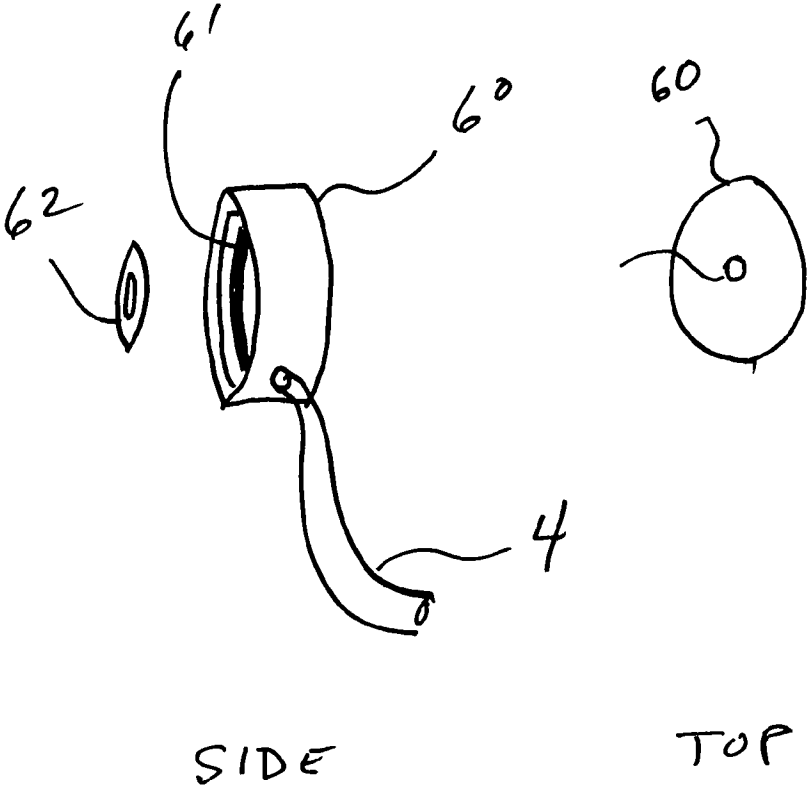
FIG. 10 is a PFTE cap that can be placed on the end of a glass capillary or other nested gaussian surface with a metal connector that can be employed to safely connect the HV to FIG. 11 shows a stylus connected via fused silica to a liquid reservoir that is in contact with the conducting part of a liquid vial holder that spray in the picoliter per second regime without touching the liquid or liquids if a plurality of such devices were made. As a result of this simple electronic and fluidics circuit liquids can fly in this case spray to lower energy without adverse electrochemistry common in electrospray as there is no physical contact of the liquid or solutes to a conductor in this embodiment of our device.
Figure 11:
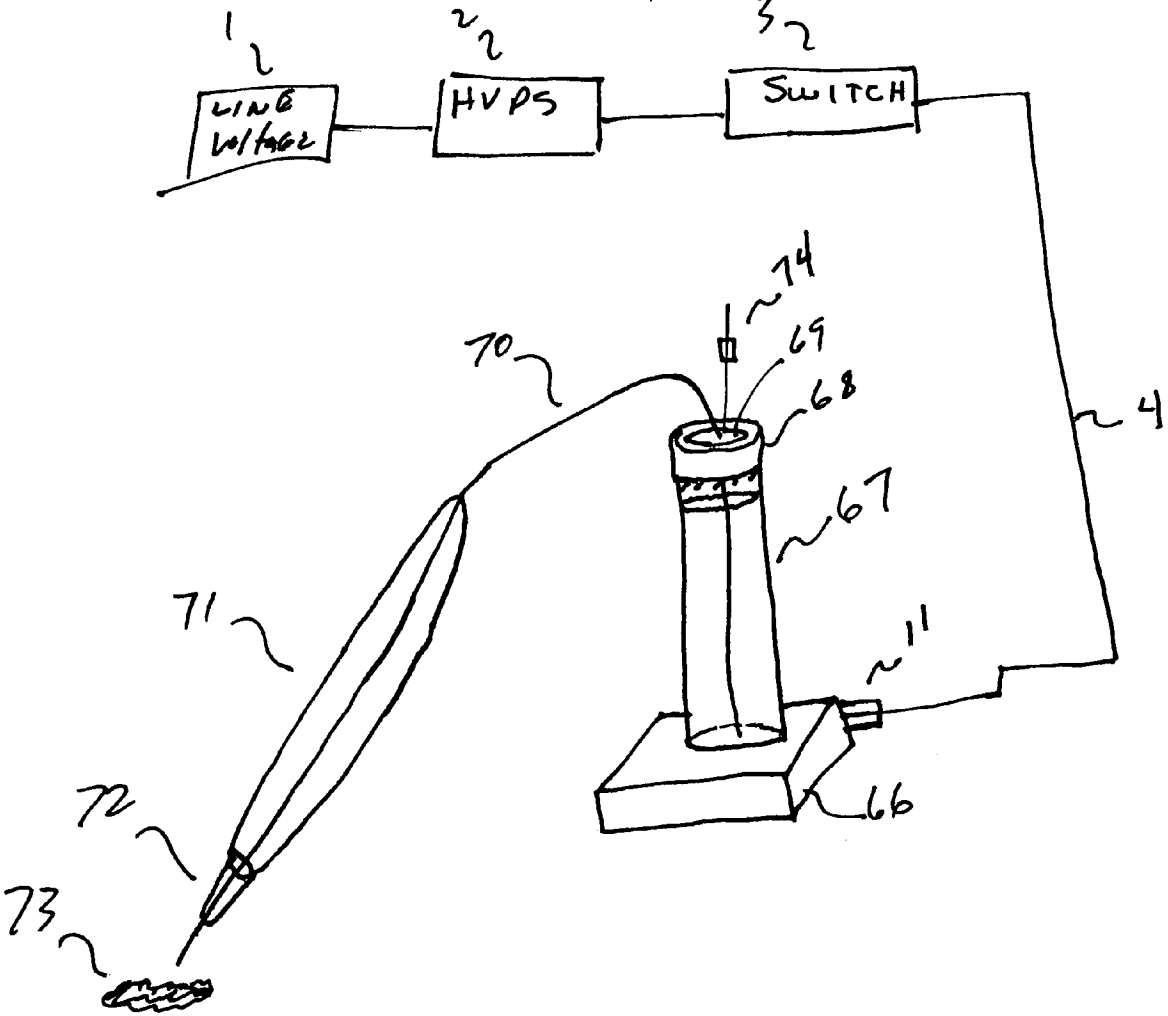
Figure 17:
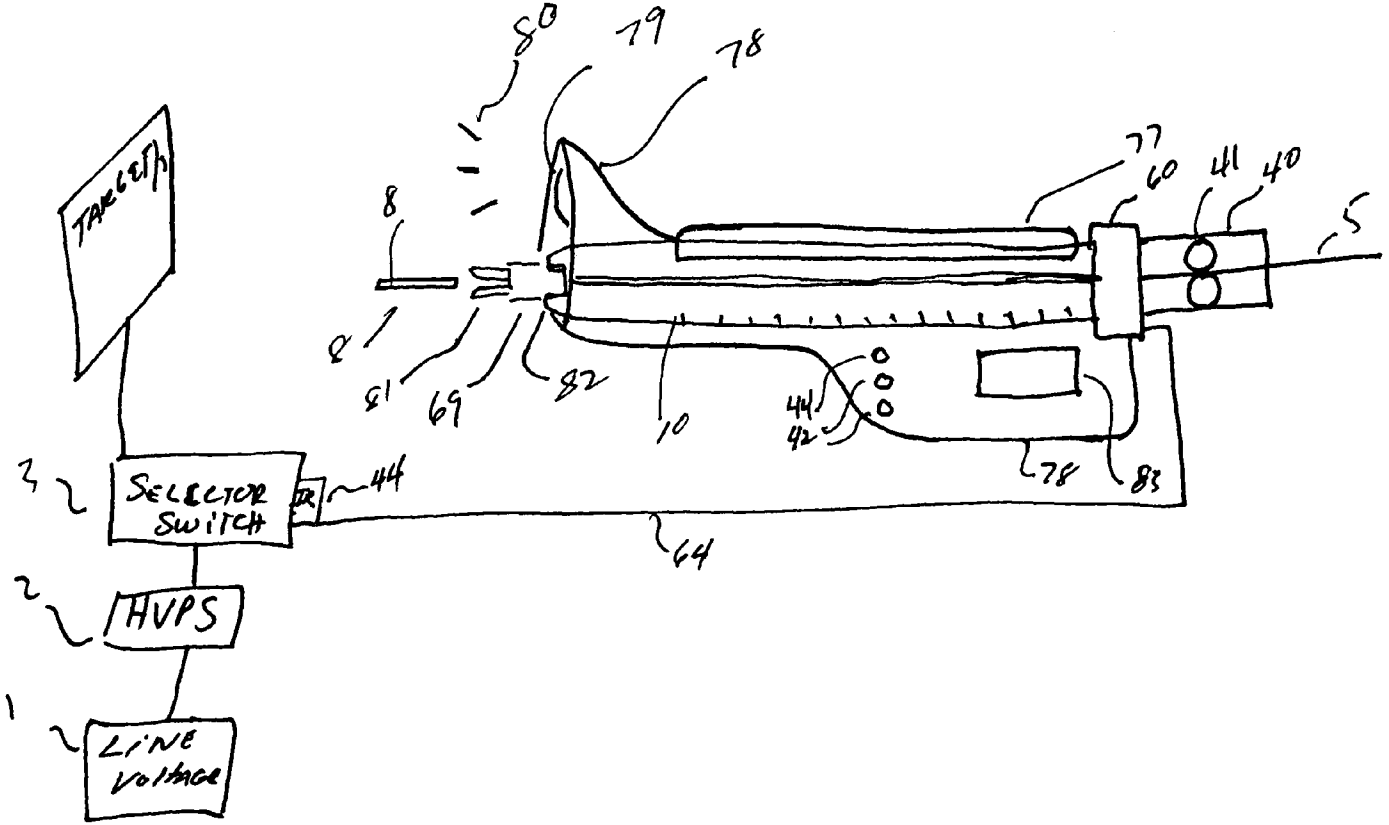
FIG. 17 shows one example of a shielded, contained induction based fluidic pump.
Figure 13:
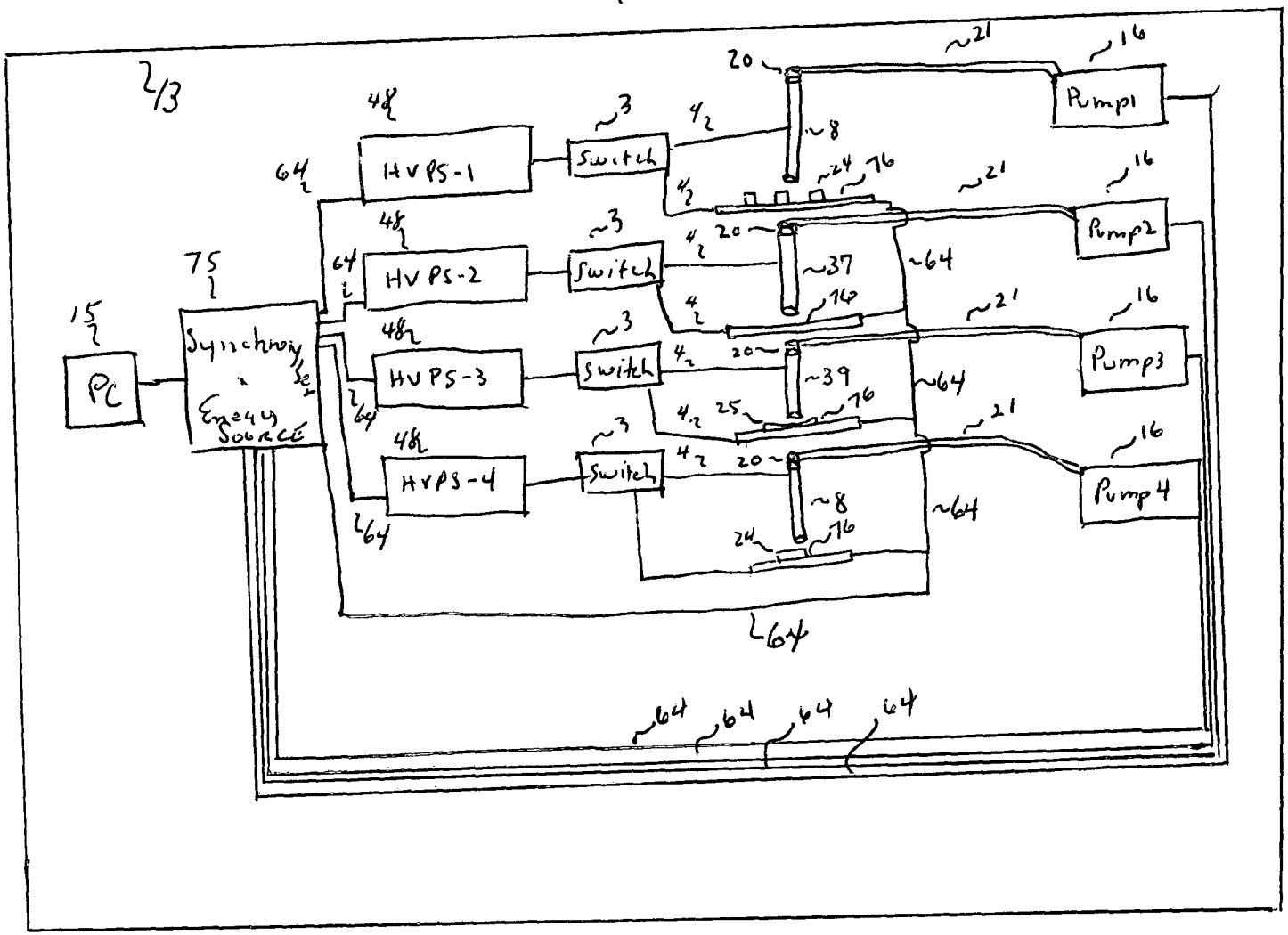
FIG. 13 shows a hybrid device where four different pumps are fed to individual gaussian surfaces that are either empty or that contain a packing like LC phase. In this configuration the pumps that provide an alternate energy source are synchronized with the electrokinetic energy supplied optionally to the surfaces themselves or to the target or targets such that the application of electric energy to the drops allow them to fall into or onto desired locations with coordinated robotic action move the targets and to place the drops.
Figure 14:
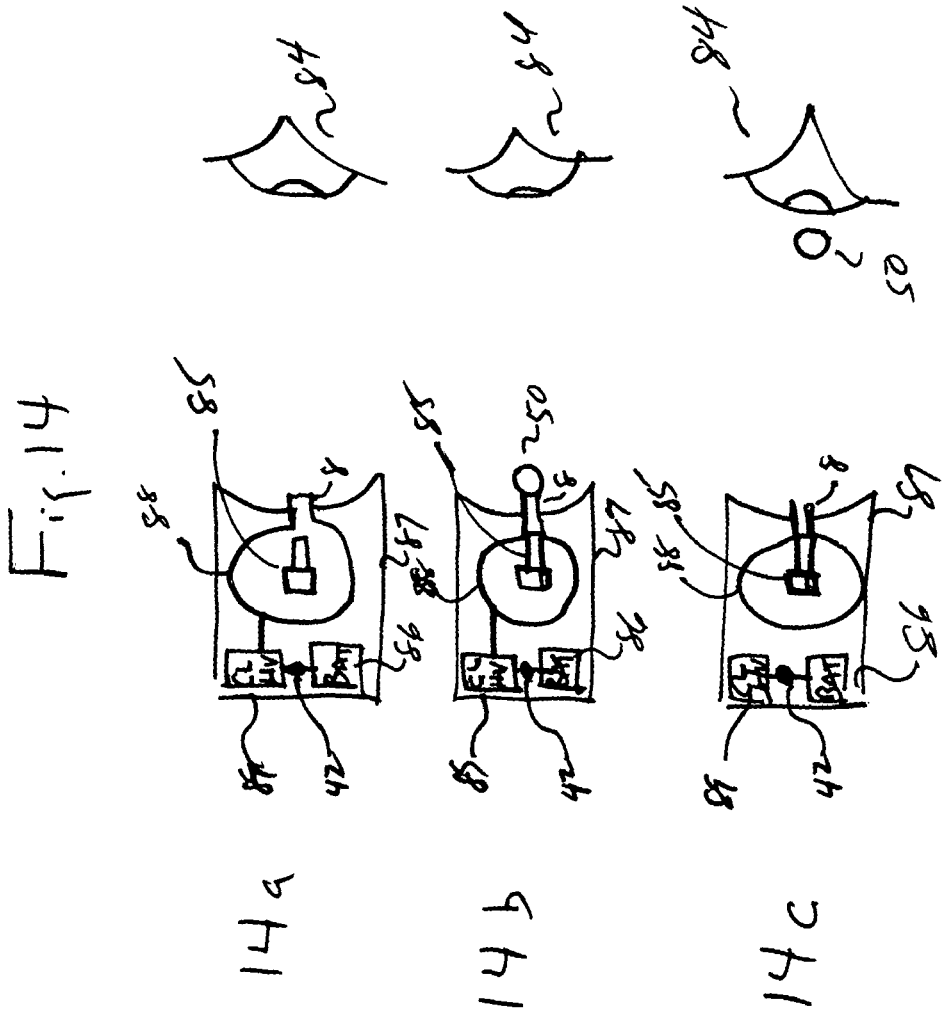
FIG. 14 shows one example of a battery operated drug delivery device such as but not limited to an eye dropper. In this version, a liquid chamber containing eye drops (14*a*) and which has a simple manual plastic piston which is depressed producing a drop of 100 mL or greater or smaller (14*b*). Upon pressing the microswitch, the drop is charged and it flies to the grounded human eye (14*c*).
Figure 15:
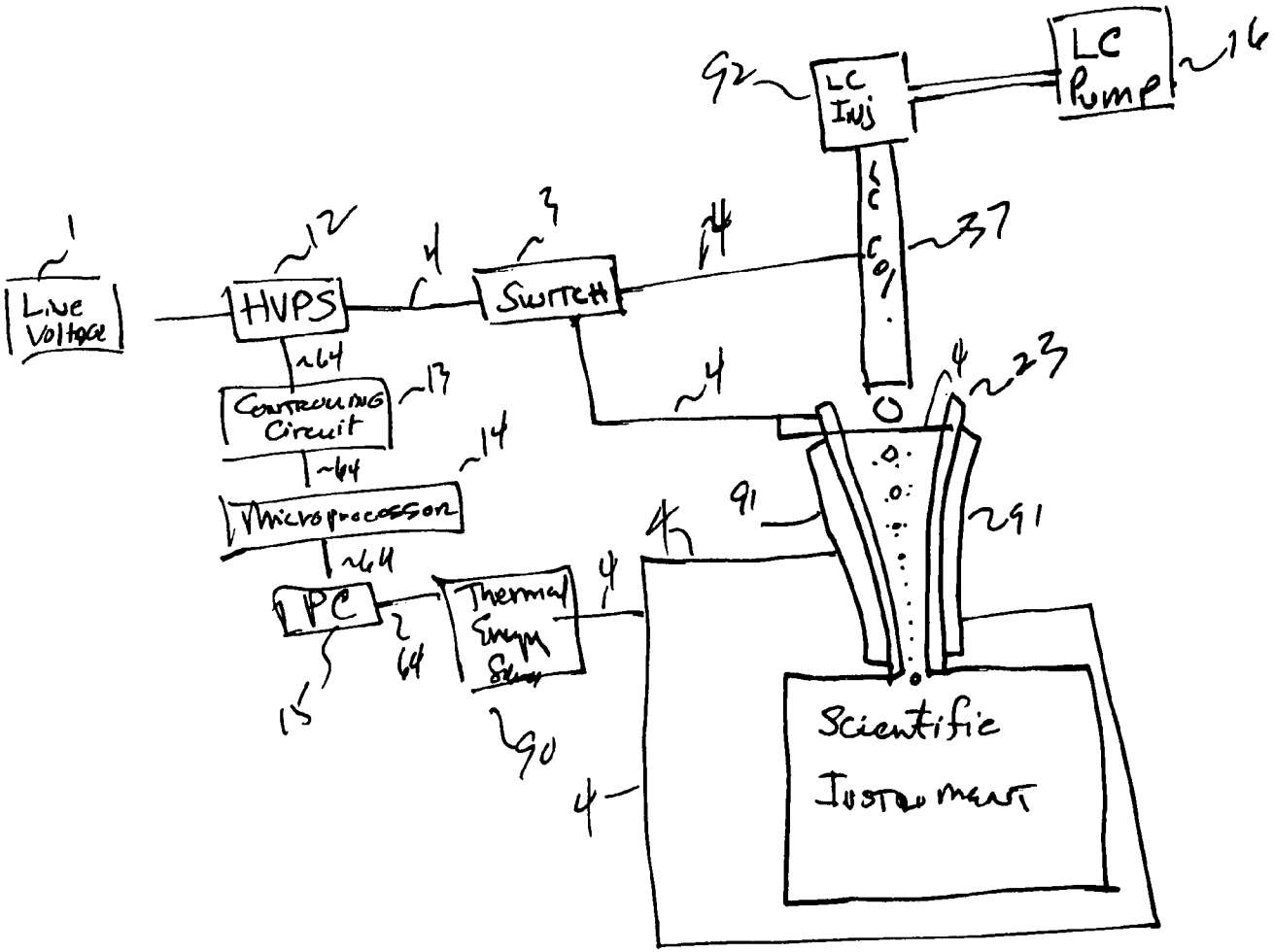
FIG. 15 show one example of an induction based fluidic liquid or liquid chromatographic scientific sample introduction device with switchable energy application.
Figure 16:
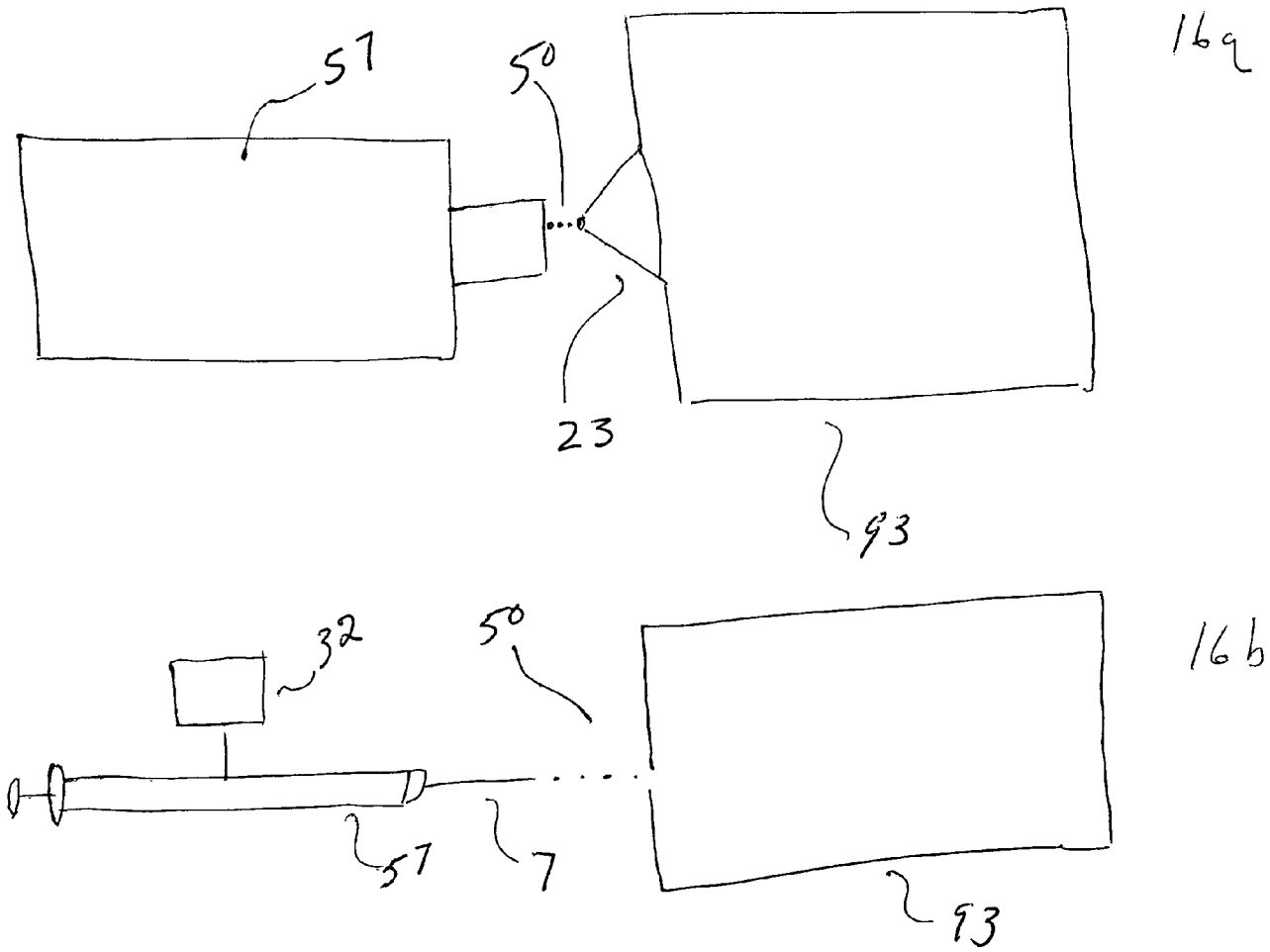
FIG. 16 shows two examples of induction based fluidic sample introduction to scientific instruments.
Figure 17:
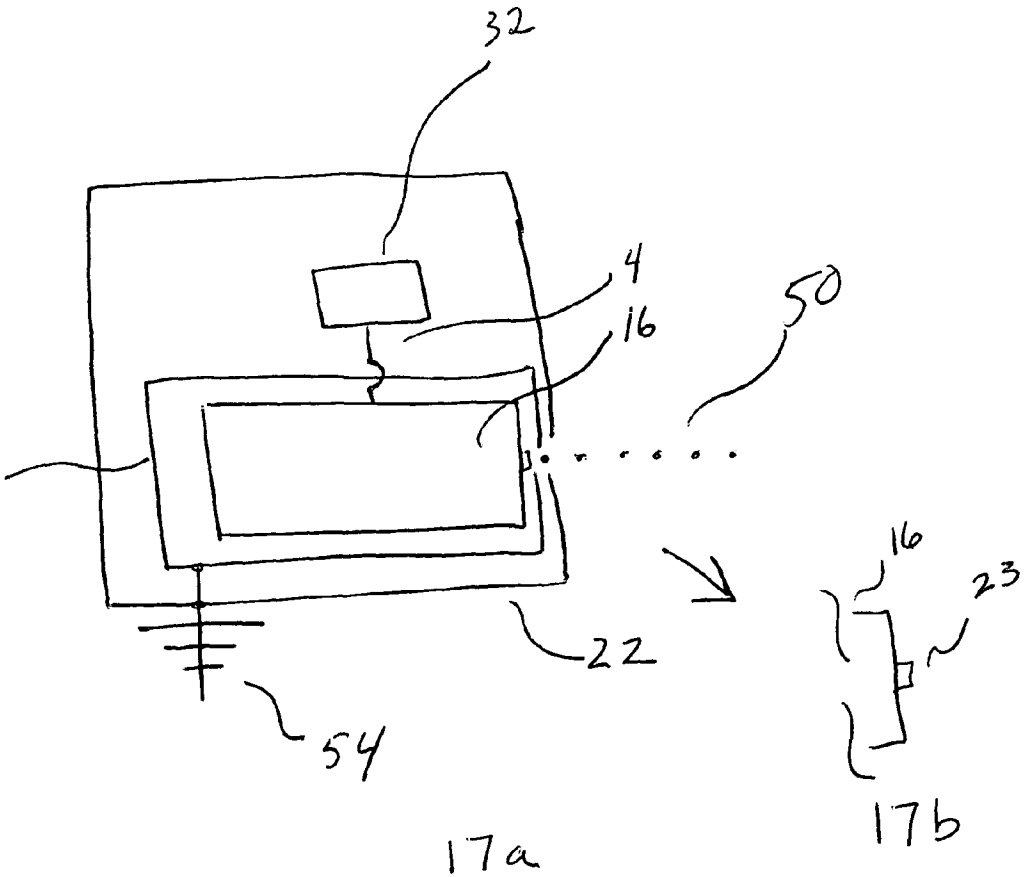
Figure 19:
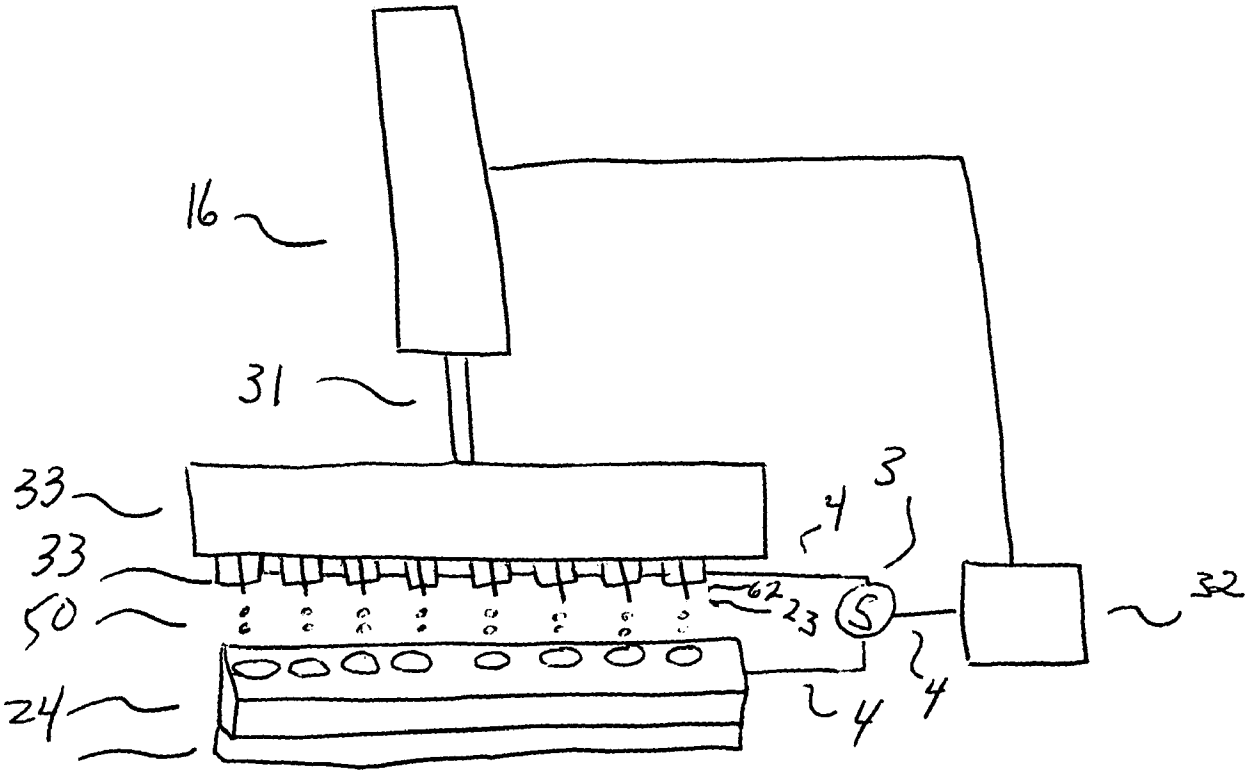
FIG. 19 shows one example of a multi-channel inductive based dispenser with switchable energy application.
Figure 20:
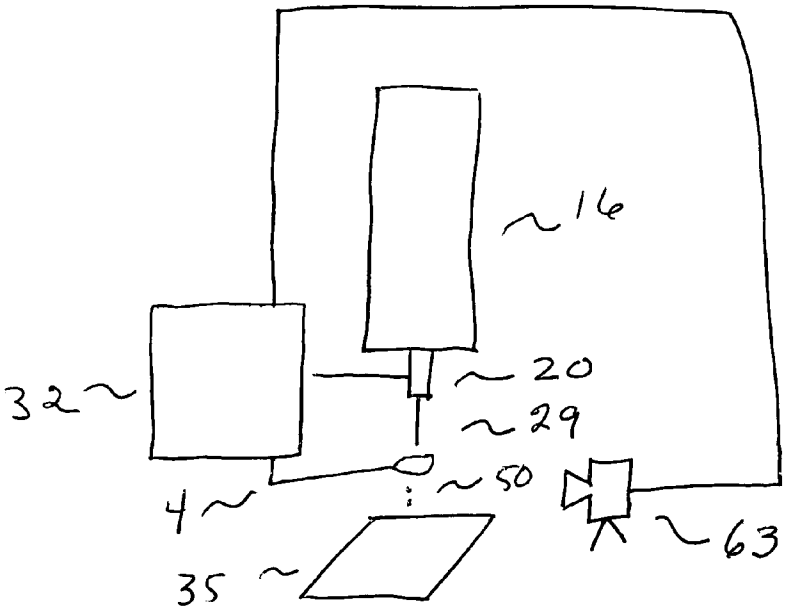
FIG. 20 shows one example of a liquid dispensing device where video data and inductive current measurement are measured simultaneously.

Femtoliter to milliliter volumes of the same or different liquids are electrokinetically dispensed, treated, introduced or transformed or alternatively using a hybrid energy approach such volumes of liquid are dispensed, treated, introduced using electrokinetic and other energy sources such as mechanical pumps, peristaltic pumps, piezoelectric driven pumps, composite ultrasonic and thermal driven pumps, siphons, pistons, gravity or other manual energy sources such as plungers and other energy sources in a high parallel manner to various effects using a simple apparatus as per FIG. 1.

In this embodiment, a standard one microliter syringe is connected using an alligator clip or equivalent via the non-conducting glass barrel to a current limited, high voltage power supply that is connected to a source of power and that has an on off switch. The plunger is manually depressed and a bead of liquid is grown on the tip of some nanoliter volume. Whereupon turning the switch on to charge the liquid and upon placing a grounded human finger within approximately 1 cm of the drop, the drop launches or flys to the grounded human target thereby dispensing the liquid, liquid drug or other liquid to a human target without touching the human. Similar approaches work for food, plants, animals and other grounded targets.

In another embodiment, tubing connected to a standard syringe pump flows to a PEEK union which has a piece of PTFE coated fused silica capillary placed at the dispensing end of the union and to which a grounded metal plate is connected. Directly below which is a conducting plate of same geometry which itself is connected to a line source of energy (e.g. 120 or 240 v), a high voltage power supply and switch and upon which a grooved piece of dry ice 1 cm thick is placed. As the syringe pump is turn on and as it feed liquid to the capillary, a drop grows on the tip of the capillary whereupon turning on the high voltage power supply simultaneous charges the liquid and attracts and drops it to the dry ice. Upon turning off the pump and the high voltage power supply, the now frozen spherical drop being charged can be literally aspirated or picked up by a charged, cooled metal rod or a charged, cooled non-conductor just a charged comb can pick up small pieces of paper.

In another embodiment, 8 LC columns of any type are connected to high pressure LC pump via a manifold and tubing. The LC columns are individually injected via either capillary action or pneumatic techniques prior to connection to the manifold with sample. The eight columns are placed into a threaded ground metal plate using PEEK unions and to the manifold where the columns are separated by 9 mm. Below this is another conducting plate of approximately 25 cm×m10 cm which is placed on a robotic stage that can move in one direction. The upper conductive plate holding the LC columns is held by non-conductors like an acrylic plastic that also has a one direction of robotic movement (e.g., vertically); such that, it can change the separation between the ends of the LC columns and the lower plate. The lower plate is also connected to a programmable bipolar, current controlled and current measuring high voltage power supply which is connected to electronics that drive the power supply and which are connected to a microprocessor that drives the controlling circuitry which can be programmed form download C++ programs using and C++ function or series of C++ functions to change the voltage applied to the charging plate as any function of time.

As such, with the injected LC columns in the manifold, once the LC pump is turned on, and parallel LC ensues, the applied potential to the charge plate can be taken to some voltage such as +2.5 kV for 4.0 sec. and then square pulsed to +3.0 kV for 0.9 sec whereupon the voltage is reset to it's original value or +2.5 kV noting that the upper plate is at ground potential. As each program is executed, the LC columns placed a few mm above the charging plate is moved horizontally by 2 mm placing such drops in a temporally aligned and spatial tight row for applications including, such as, a MALDI target production for subsequent MS analysis by MALDI TOF MS for disease diagnosis, biomarker identification, polymer analysis, surface analysis or other applications.

In another embodiment of this technology a piece 20 cm piece of fused silica is placed into a liquid which contains a mixture of fluorescent chemicals, optionally liquids containing quantum dots based chemicals or other chemical species effecting a siphon. The tube of diameter 20 microns is attached to a charging plate and that to high voltage power supply and held above a grounded metal plate that rides on a robotic stage upon which targets such as pills, labels, food, identification materials and other targets are placed. When such targets are beneath the dispensing tip, the HV supply is energized dropping the liquid onto the grounded target for later identification or other purposes. Optionally, such dispenser or dispensers can be taken to high voltage (e.g., 15 kV) effecting a spray or a coating for a variety of purposes. Noting that as the liquid is not in touch with conductors, there can be no adverse electrochemistry, i.e. faradaic processes.

Another embodiment of the device is as a motorized syringe which has a plunger connected to a motor that drivers the former and with other accoutrements which can grow small drops on a tip which can be disposable and from which drops can be subsequently launched without touch or with touch drops to targets. Such a syringe is held in a plastic enclosure that contains other options including: a light to see the liquid, a laser pointer with focus for placing spots of known dimensions on targets for subsequent analysis by the video camera or jpgs resulting from vision analysis software output, a lens system to manually see the liquid and to read the scale, microswitches to display/select functionality via an IR remote or direct connect line to the base instrument, an LCD panel to display the volume or plunger locations or both, an LCD display to present syringe status and options, and optional rechargeable batteries on board and a power cord. This embodiment can also have an optional charge base made optionally or either non conductors such that charged drops expressed on the disposable tips can be literally flown to the charged grounded target non-conducting targets in a manner similar to how water drops are attracted to charged tube based TV or computer monitors.

Another embodiment of the device is a charged station where standard Hamilton (e.g., a Hamilton 701RNFS 10 uL syringe with the fused silica tip cut to 4.0 cm or with an alternate fused silica tip coated with PTFE) or other microliter syringes or containers containing liquids (e.g. 150 u capillaries with 146 u fiber optic plungers) can be placed onto conducting cradles. Such cradles are covered by non-conducting lids. Whereupon turning on an inexpensive, current limited the high voltage power supply connected to the cradles that hold the syringes or containers that contain liquids, charge the liquids therein. Subsequently, upon turning off the power supply, the devices can be removed by a gloved or non-gloved but not grounded human. Where upon manually expressing a drop to the tip of the syringe, and lowering it to a grounded surface, the drop flies to the grounded surface or target. This action can be repeated as long as the liquid remains charged.

In another embodiment manually aspirating a liquid into a Hamilton (Reno, Nev.)701RNFS 10 uL syringe with the fused silica tip cut to 4.0 cm or with an alternate fused silica tip of the same dimensions coated with PTFE that is handheld by a non-grounded individual or by one wearing non-conducting gloves or alternately can be placed in a non-conducting mount like Panavise, is directly connected to the non-conducting body of the syringe via alligator or via an insulated HV shielded wire to the Teflon cap such that the conducting wires are not exposed, is connected to a Model No. 750 120 VAC-7.5 kV high voltage power supply from the Electronic Goldmine, which is connected to an autotransformer (e.g., Staco Energy Products, Model No. 3pn1010) which is connected to normal 120 v line voltage.

With the liquid in the syringe and manually expressing approximately 200 mL, and taking the device to 50 percent full power using the autotransformer, and placing a target to 1.0 cm of the drop, and then rapidly turning the dial of the autotransformer to 75 percent full power the drop flies to the target, e.g., a grounded human finger.

In a related version with the same device, the plunger is manually depressed continuously as the autotransformer is at 100% full scale and a fine spray results on the target.

In a related version of the a similar device modified to have a coaxial non-conducting cylindrical shield extend over the end of the syringe barrel, and up to the end of the drops location, it is found upon depressing the plunger of an energized system that the spray is not created, but rather a drop remains for subsequent launching to a grounded target upon energizing same and pointing it to close to (e.g., a few cm) to ground.

In another embodiment of the device a twenty-four channel peristaltic pump (Idexcorp., Chicago Ill.) has its 24 lines brought to 24 PEEK unions and fitted with PEEK tubing such that standard 360 micron fused silica tubing of 150 micron ID can be joined thereto. This array is placed into a conducting plate with three lines of eight holes each row separated by 9 mm as per standard microtiter plate geometry with the tips of the capillaries being held on pipette tips, Plastibrand of Germany, 100 uL, above the ground plate by approximately 6 mm with a plate to plate distance of approximately 3.5 cm. The charge plate being connected to a AHV system 200 watt power supply and the ground plate being connected to that device's electrical ground. The charging plate is connected to non-conductors connect it to a z axis robotic system and the ground plate being connected to a z axis robotic with each plate being 10 cm×25 cm×1 mm. Upon the ground plate, a microtiter plate is placed and secured by plastic chuck, Upon the initiation of the primed pump, the microtiter plate is moved under the 24 channels and at the appropriate time (e.g., 1, 2, 5 10, 20 seconds, as selected), the HV supply is energized, as the current is measured dropping the 24 drops into the microtiter plate. This is repeated two more times, and in seconds a 96 microtiter plates has had liquids placed into it without touching the container.

In yet another embodiment of this device that is identical to the immediately preceding example except that each line of the peristaltic pump is has a unique liquid or in another identical version of the same device using a 96 channel peristaltic pumping 96 different liquids where one dispense cycle can place 96 liquids into one microtiter plate with great rapidity.

In yet another embodiment of this class of devices, any glass vial with a septum lid containing a liquid can be charged by placement into a conducting or a non-conducting holder that is connected directly to an AHV system 100 watt programmable DC power supply. A tube (e.g., od 360×id 100 u fused silica) is placed into the liquid and out of the top of the vessel through a septa with an optional vent. The tube further goes into a stylus that can be handheld. With siphon flow initiated, the HV source can be turned on resulting in a extremely fine spray in the pL/sec regime that results from the when the tip is a cm or so from ground. Such sprays can be placed on paper placed on electronic ground. Alternatively, the same device can be employed to dispense liquids onto non-conductors when it is they that are the charged targets and when they are charged in a siphon or pump based system.

In an identical embodiment of the preceding example, the dispensing tube goes to a manifold with eight outputs that can place the same liquid in eight locales concurrently.

In one further embodiment the device is employed to send charged liquids into scientific instruments directly from LC columns without creating or with creating a spray where in the former mode, MS sensitivities are greatly increased as a great fraction of the analytical sample reaches the instrument; such as a mass spectrometer.

All or anyone of these devices can be placed into a fume or environmental chamber or faraday cage or all three to affect a controlled environment.

DRAWING REFERENCE NUMERALS

1. Line voltage: approximately 120v@15 a.
2. High voltage power supply that is current limited.
3. Switch
4. Electrical lead, typically HV shielded.
5. Plunger
6. Nested gaussian surface, e.g., a syringe barrel, a capillary alternatively a cone.
7. Zero dead volume compression union.
8. Nested gaussian surface, in this case the preferred type is PTFE coated fused silica.
9. A target, conducting surface connected to ground potential.
10. A scale.
11. A lead connector.
12. A programmable high voltage power supply, that is optionally bipolar, current controlled, arc protected.
13. Electronic circuit to drive the programmable high voltage power supply (HVPS).
14. Microprocessor to drive the electronic circuit that drives the HVPS.
15. PC to program the microprocessor.
16. Pump of many kinds.
17. Liquid reservoir.
18. Three way valve.
19. Liquid reservoir supply.
20. Union.
21. PEEK tubing.
22. A fume hood and composite electrical shield or faraday cage.
23. A shape that can be charged in either an active or passive sense aiding drop formation launch and direction.
24. A receiver such as a microliter plate well, a beaker, etc.
25. A piece of grooved dry ice, i.e., solid CO2.
26. Frozen charged drop collector
27. Robotic platform
28. Grounded metal plate.
29. PFTE coated fused silica coating.
30. Glass lined PEEK tubing.
31. PEEK low dead volume union.
32. Bipolar high voltage power supply that is current limited, arc protected, with computer control and current and voltage read outs and a GUI interface.
33. Composite Manifold/Injector (e.g., a 9 fold of T fittings)
34. Thin non-conductor, e.g. paper, PI. IE sheet, nitrocellulose.
35. Conductive plate.
36. Electrical connectors such as wires, or serial or parallel port communication devices.
37. Monolithic or other liquid chromatography columns.
38. Holding laminate mode of non-conducting top and conducting bottom (in this case) materials.
39. Threaded glass capillary tubing.
40. An electric motor.
41. Wheel and gear train for plunger movement.
42. On/Off button/switch, a micro-switch.
43. Threaded glass tube.
44. IR remote for selector switch circuit activation and energy path selection.
45. Threaded cap to body of tubing.
46. Metal compression fitting.
47. Teflon cylinder or bushing
48. Negative HVPS that is current controlled, current limited, that measures current and that is arc protected.
49. Ammeter, current measuring device.
50. Charged liquid drop.
51. Fiber optic acting as a plunger.
52. Capillary of any type.
53. Capillary compression typically used in gas chromatography to join fused silica.
54. Electrical ground.
55. Circular current sensor.
56. Fiber optic end cap.
57. Hamilton 701 RNFS 10 uL microliter syringe.
58. Uncharged drop.
59. Ground human thumb or any other appendage.
60. PFTE energy connecting end cap.
61. O ring.
62. Conducting ring.
63. Video camera and vision analysis software.
64. Power and data lines (e.g., for communication) that optionally can be disconnected.
65. Insulated holder.
66. A conducting holder that is coated with a non-conductor except where the vial touches the block.
67. Liquid screw cap container.
68. Screw cap.
69. Seal or septum.
70. Any type of accurately made non-conducting tubing, like fused silica.
71. Stylus.
72. Pipette Tip.
73. picoliter volumes liquid spray
74. Optional vent & clamp.
75. Synchronizer and energy source.
76. Non-conducting or conducting targets or vessels on a robotic axis.
77. An optical lens.
78. Holder or body containing circuitry, batteries, switches, connector and other accoutrements.
79. Light emitting diode.
80. Photons, i.e., light.
81. Conical quartz 150 u glass connectors used to join fiber optic devices.
82. Glass capillary.
83. Display device.
84. Human eye.
85. Fixed length manually operated piston.
86. Battery
87. Drug holder, dispenser.
88. Liquid chamber.
89. Battery operated current limited, high voltage power supply.
90. Thermal energy supply, computer controlled.
91. Resistance or other heaters.
92. LC injector.
93. Scientific instruments, e.g., a mass spectrometer.

What is claimed is:

1. An apparatus a) for accurately inductively transporting or dispensing one or a plurality of liquids, in microliter to picoliter volume ranges, and b) for accurately and precisely in both volumetric and spatial terms delivering drugs, anethestics, taggants and other liquids, suspended solids or other fluids to products of all types, drugs or prescriptions, food, plants, animal and human subjects, scientific and other instruments or related targets c) which is useful for manufacturing one or more charged functionalized solid entities or mixtures thereof d) which is useful for the purification and treatment of fluids which is comprised of:

at least one syringe having one or more nested gaussian surfaces being made of non-conducting materials; a power supply coupled to said one or more gaussian surfaces to directly pump or otherwise energize and provide liquid flow from at least one syringe having said one or more nested gaussian surfaces; said coupling being through electrical leads individually connected to a power supply and the exterior of 1) said one or more nested gaussian surfaces or 2) a non-conducting holder of said at least one syringe, or 3) to otherwise electrically disconnected targets upon which said liquid is to be dispensed, and wherein a second of 1) said one or more nested gaussian surfaces or 2) a non-conducting holder of said at least one syringe, or 3) to otherwise electrically disconnected targets 3 is connected;

wherein the at least one syringe is optionally connected to a manifold supplying said one or a plurality of liquids to the at least one syringe;

wherein a circuit connecting said power supply to said one or more gaussian surfaces further optionally includes an on/off switch, a device for measuring current and voltage, a selector switch and an optional means for connecting said circuit to a microprocessor for electronically controlling said transporting, dispensing or treating;

wherein said targets, syringes or both are optionally arranged on a robotic platform which provides for relative motion between said targets and said at least one syringe;

and wherein said apparatus further optionally includes a vision analysis system including a video camera with electronic lens and vision analysis software for real time or post acquisition detection and quantification of said transporting or dispensing in conjunction with aforementioned current measurements.

2. The apparatus of claim 1 wherein the power is applied to selected nested gaussian surfaces or to any of 1) said one or more nested gaussian surfaces or 2) a non-conducting holder of said at least one syringe, or 3) to otherwise electrically disconnected targets by using a programmable bipolar, high voltage power supply with controlling circuitry.

3. The apparatus of claim 1 wherein the power is determined via a manual selector switch or fast relay switch or switches or equivalent to go to any moveable lead that can be connected to the exterior of 1) said one or more nested gaussian surfaces or 2) a non-conducting holder of said at least one syringe, or 3) to otherwise electrically disconnected targets using one or a plurality of high voltage power supplies, RF power supplies or any combination thereof that are optionally computer controlled.

4. The apparatus of claim 1 wherein a moveable parabolic, cylindrical or otherwise shaped nonconductor or conductor is placed at the distal end of one of the last nested gaussian surface and where the gaussian surface or a plurality of surfaces is conical or cylindrical or other gaussian geometry and is joined via a zero dead volume compression union or otherwise fitted with a high precision tube of an exact length, the former with an optional side opening, that is connected to an alternate energy source such as a single or multichannel liquid displacement device which can also be placed into an inductive electrical charging unit to fly drops to grounded targets or to have drops fly to charged targets.

5. The apparatus of claim 1 wherein one or a plurality of movable insulated electrical leads with clamps or other attaching devices are attached to 1) said one or more nested gaussian surfaces or 2) a non-conducting holder of said at least one syringe, or 3) to otherwise electrically disconnected targets and to either an HV electrical energy source or sources or electrical ground.

6. The apparatus of claim 1 where at least one of the coupled, nested, gaussian surfaces is connected via a T fitting equipped which contains an injection septa or valve and that also has another gaussian surface that contains either LC chromatographic medium of pelicular or monolithic variety, solid phase or other extraction medium, biological trapping media, a filter or sequential filters and or a frits optionally each being of similar or of varied dimensions and composed of similar or dissimilar materials.

7. The apparatus of claim 1 further comprising one or a plurality of cross fittings in the manifold which are rotatable and are of such volume to accept a capillary containing a liquid or liquids, and then be rotated back in line injecting such liquids for highly parallel hybrid electrokinetic, pneumatic high or low pressure LC with optional sample placement for MALDI or other testing techniques.

8. The apparatus of claim 1 where one or all of the coupled nested gaussian surfaces or a single nested gaussian surface or the last coupled, nested gaussian surface is disposable and that is optionally a compression or otherwise fit with a zero dead volume fitting to the an alternate supplier of liquid and energy, with a tip that is cut flat, beveled, multi-cut or composed of spherical surface whose parts may be coated on the exterior or the interior or with PFTE, PEEK, other perfluoropolymers, polyimide, organosilicon compounds or other surface coatings with high pointiness; such as, carbon nanorods made with nanotechnology processes.

9. The apparatus of claim 1 where one of the nested gaussian surfaces or a plurality of coupled, nested gaussian surfaces are placed in a holder made of non-conducting or conducting material which are charged inductively or conductively with an energy source or sources such that the lumen of said syringe and its contents are electrically charged individually or collectively and where one of the power supplies is optionally a radiofrequency (RF) power supply and where such a holder or in a plurality of such holders that are electrically isolated.

10. The apparatus of claim 1 wherein one or a plurality of sensing devices are positioned between a last gaussian surface and the target or targets such that induction only current and the liquid flow or rate of change of the induction only current and flow rate is measured by an appropriately connected ammeter, electrometer or other appropriate current measurement and storage microprocessor and/or computer, and simultaneously visually detected and measured with appropriate vision systems.

11. The apparatus of claim 1 wherein a functional synchronizing timing circuit is coupled to one or a plurality of power supplies and alternate energy supplies; such that, actions and functions of each are synchronized.

12. The apparatus of claim 1 wherein the syringe containing fluids is surrounded by other conducting gaussian surfaces that are grounded and that serve to electrically shield charged interior gaussian surfaces from each other or each from the exterior of the device and where such shields are optionally connected to one large an encompassing grounded shield optionally with the device contained in a enclosure with temperature, humidity and particulate matter controlled using computer controlled circuitry with an optional IP remote control.

13. The apparatus of claim 1 where one or a series of cylindrical coils of a conductor is coupled to or placed near and beyond the distal end of said at least one syringe to charge said syringe of either polarity and timed such that the polarity can accelerate or otherwise alter the trajectory of charged drops.

14. The apparatus of claim 1 wherein the energy supply or supplies are current limited and optionally have arc protection circuitry and where the apparatus of claim one optionally has an RF power supply whose output can be combined and or mixed in any proportion with the output from any DC power supply.

15. The apparatus of claim 1 wherein said one or a plurality of nested gaussian surfaces or a plurality of coupled, nested gaussian surfaces are held in a secure hybrid mount that secures LEDs to illuminate the target and optionally having a laser with a focusing element to place a spot or spots of known size at a fixed distances for calibration purposes, optionally attached to a robotic system, optionally having a camera to visualize the scale, or the surfaces and liquids therein, connected whose output is connected to a computer for real or post acquisition data analysis.

* * * * *